United States Patent [19]

Dillon, Jr. et al.

[11] 4,266,842

[45] May 12, 1981

[54] TRANSMISSION LINE ACTIVE COAXIAL TAP

[75] Inventors: Robert F. Dillon, Jr., Rancho Palos Verdes; James J. Hall, Encino; Leon N. Zamfirescu, San Pedro, all of Calif.

[73] Assignee: Zerox Corporation, Stamford, Conn.

[21] Appl. No.: 76,059

[22] Filed: Sep. 17, 1979

[51] Int. Cl.[3] ..... H01R 4/24

[52] U.S. Cl. ..... 339/97 P; 339/122 R; 339/177 R

[58] Field of Search ..... 174/5 LR; 339/97 R, 339/97 P, 176 R, 177 R, 177 E, 126 R, 126 F

[56] References Cited

U.S. PATENT DOCUMENTS

| | | | |
|---|---|---|---|
| 2,164,381 | 7/1939 | Bradley | 339/97 R |
| 2,477,955 | 8/1949 | Boynton | 174/21 |
| 2,754,487 | 7/1956 | Carr et al. | 339/102 |
| 2,805,399 | 9/1957 | Leeper | 333/6 |
| 3,107,135 | 10/1963 | Keil | 339/103 |
| 3,530,425 | 9/1970 | Vachhani | 339/95 |
| 3,543,222 | 11/1970 | Rheinfelder | 339/99 |
| 3,602,872 | 8/1971 | Braunstein | 339/97 R |
| 3,980,382 | 9/1976 | Reeder | 339/177 R |
| 4,120,554 | 10/1978 | Bianchi et al. | 339/177 R X |

FOREIGN PATENT DOCUMENTS

| | | | |
|---|---|---|---|
| 1277977 | 9/1968 | Fed. Rep. of Germany | 339/97 R |
| 2046213 | 3/1972 | Fed. Rep. of Germany | 339/177 R |
| 700163 | 1/1966 | Italy | 339/97 R |

*Primary Examiner*—Eugene F. Desmond
*Attorney, Agent, or Firm*—Franklyn C. Weiss

[57] ABSTRACT

A coaxial cable tap is utilized to couple transmitting and receiving devices to a transmission line. An electrical probe (301) is inserted into a coaxial cable (10) to separate the outer braided conductor (12) and to contact the center conductor (14) of the cable. A mounting block (401) is mounted in a metal clip or band (501) to support the electrical probe (501) and provide electrical contact. The metal band (501) has two prongs (509, 511) to pierce the outer cover and contact the outer braided conductor of the cable. This apparatus is then mounted in a connector box (101) for support, protection and connection to the transmitting/receiving devices.

2 Claims, 9 Drawing Figures

TRANSMISSION LINE ACTIVE COAXIAL TAP

The invention relates to a transmission line active coaxial tap; the tap is utilized as a low loss connection apparatus to a coaxial cable transmission line without having to cut the line itself.

BACKGROUND OF THE INVENTION

The transmission of information from one place to another can be accomplished, of course, by wire, laser light, radio waves, etc. Once the transmission medium is chosen, connection to the medium by the transmitting and receiving devices becomes important.

One type of transmission medium is the coaxial cable. The standard type of coaxial cable has a center conductor, such as copper, either a solid strand or many smaller strands woven together. Surrounding the center conductor is a core of insulating material having predetermined dielectric properties also, such as plastic or Telfon. The outer, or ground conductor, in turn surrounds the insulating core and is usually in the form of a cylindrical braided material such as copper. The outer material of the cable, which could be rubber or plastic, serves to protect the braided material from damage, and to prevent short circuits by contact with external signal sources or ground.

Once the transmission line and the transmitting and/or receiving devices are in place, connection of the devices to the line is the next step. If a single transmitter is connected to a single receiver, a length of the transmission line can be installed and the ends thereof prepared with plugs compatible with connectors, as is known in the prior art. In a campus atmosphere or where a large number of users are connected to a transmission medium, such as a community antenna television system (CATV), cutting the line to prepare the ends with proper connectors is not practical. Every time a customer or user is coupled to the medium, as in the beginning of service, or decoupled from the line, as in maintenance or termination of service, transmission for all customers and/or users is interrupted because the line is open circuited, albeit for a temporary period. It becomes attractive, therefore, to have a coaxial cable connection tap which provides dependable electrical connection to the cable, but allows easy connection and disconnection therefrom, without interruption of service to other users.

SUMMARY OF THE INVENTION

According to the present invention, a low loss transmission line active coaxial tap is disclosed. A metal bank or clip is inserted around a coaxial cable to securely grip the cable. The clip also has piercing-type fingers to penetrate the outer insulation and make contact with the metal braided outer conductor. An insulating retaining block is also mounted in the band to complete the secure mounting of the metal band. A hole in the block allows a molded plastic screw with a pointed metal needle probe to pierce the coaxial cable, the needle portion making contact with the center, usually solid, conductor and the plastic portion separating the braided conductors and preventing contact with the needle probe.

This assembly is then mounted in a small insulating box whereby contact with the other end of the needle probe and connection to the metal band is made to complete coupling to both conductors of the cable. Mounted in the insulating box can be active circuits to provide impedance matching, signal collision detection circuits, modulation and demodulation circuits, as necessary. The box may also contain connectors for coupling the box to the transmitter, receiver or other unit which could be a few feet or more away from the cable itself.

DESCRIPTION OF THE DRAWINGS

For a more complete understanding of the invention, reference may be had to the following detailed description of the invention in conjunction with the drawings wherein.

DETAILED DESCRIPTION OF THE INvENTION

Figure 1A:
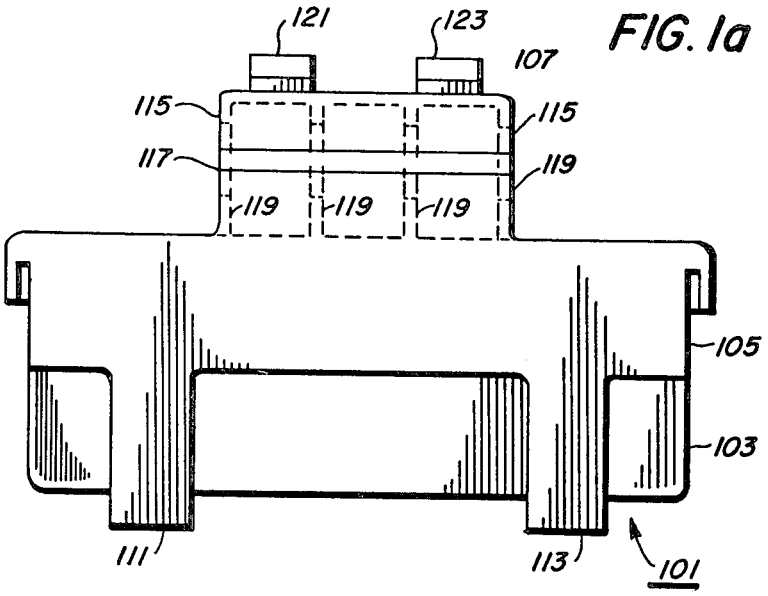
FIG. 1A shows a front view of the connector box with a part in section; with FIG. 1B showing the same front view of the connector box with the apparatus connected to the cable, now shown in place in the box.
Figure 1B:
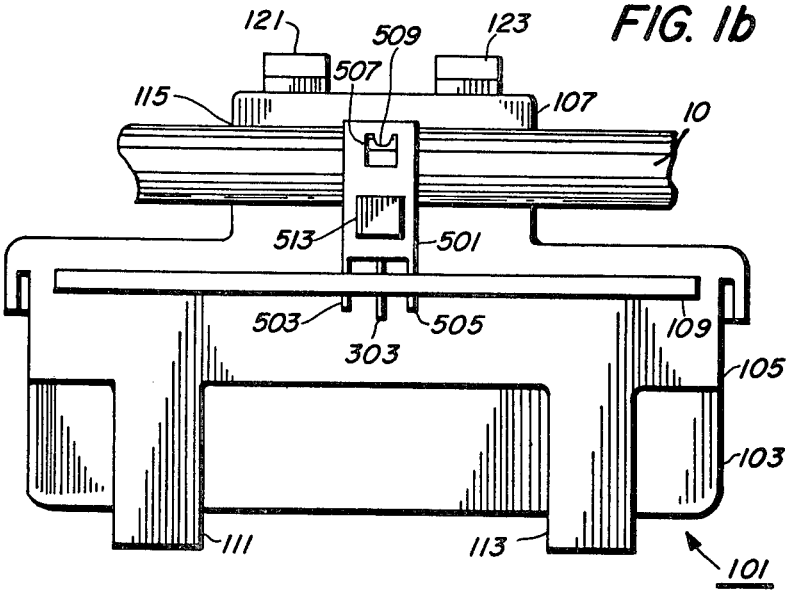

As part of the coaxial tap unit, the connector box 101 shown in FIGS. 1 and 2 may be made of polypropylene or similar material. FIG. 1A shows the front view of the connector box 101 in the closed configuration as it would be when mounted in position. The box 101 is in three main sections. The bottom section 103 contains the active circuits, if necessary, for providing the impedance matching, etc., provisions as set forth above. FIG. 1B shows a circuit board 109 in the approximate position in the box it is actually situated. There would be, of course, support struts and protuberances within the box to support the circuit board or boards and any other necessary apparatus. One such apparatus could be a connector for connecting the transmission line from the box to the transmitting and/or receiving unit.

The middle section or cover 105 is pivoted on the back side as seen later in a subsequent figure. Extensions 111 and 113 are feet which when the cover 105 is joined with the bottom section 103, keep these two sections together in a closed relationship. The material that the box 101 is made of is resilient and allows the closure of the box to be made with very small hand effort but does provide a sure and definite closure action.

The top section 107 provides the support and actual connection to the selected transmission line. FIG. 1B shows the line 10 in position in the top section 107 of box 101. Both FIGS. 1A and 1B are shown in part section for the top section 107 to show the construction of the box 101 and the placement of items within the box. FIG. 1A shows the hinge 117 of the top section 107. The cover section 105 opens up with the opening toward the viewer in FIGS. 1A and 1B. The top section, however, opens up with the opening away from the viewer and into the paper. Feet 121, 123, similar to feet/extensions 111, 113, are used to maintain a closed position of the top section 107. Again, the material is resilient and allows easy hand closing, but provides for a secure closing and locking of the top section.

Hole 115 is provided in the support ribs 119 to allow for placement around the selected transmission line 10. The hole and support rib are sized initially for the size of the particular transmission line chosen. A larger diameter transmission line would require a larger top section 107, with concomitant larger holes 115 in the rib support sections 119.

FIG. 1B shows a particular line 10 in place in the top section 107. The box 105 is closed and is shown in the operating configuration. Metal band 501 is in position on the line 10. The hole 513 is provided for lateral support of the mounting block seen and described in conjunction with FIGS. 4A and 4B below. Two of the projections 503, 505 of the band 501 are shown projecting through the circuit board 109. These projections (only two of four of which are visible in FIG. 1B) provide the ground or return signal path from the cable 10 to the circuit board 109. Part of one piercing finger 509 is seen piercing line 10. The other finger is not seen as being behind the line 10. These two fingers 509, 511 pierce the outer corner of the cable 10 and make contact with the circumferential braided outer conductor.

The center conductor of the cable 10 is contacted by probe 301 seen and described below in conjunction with FIGS. 3A and 3B. Only the center conductor 303 of the probe 301 is seen in FIG. 1B. This conductor 303 also projects through the circuit board 109. Connections for feet 503, 505 and conductor 303 (which is the signal carrying lead to and from the cable 10) are connected to the circuit board 109 by soldering, friction connections, or other prior art techniques.

Figure 2A:
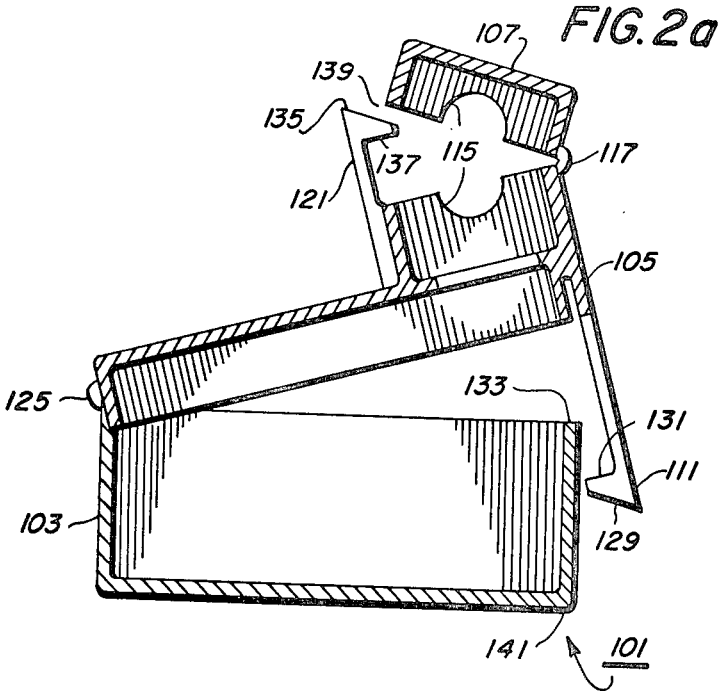
FIG. 2A shows a side view, partly in section, of the box shown in FIGS. 1A and 1B in an open configuration; with FIG. 2B showing the same box in the closed configuration.
Figure 2B:
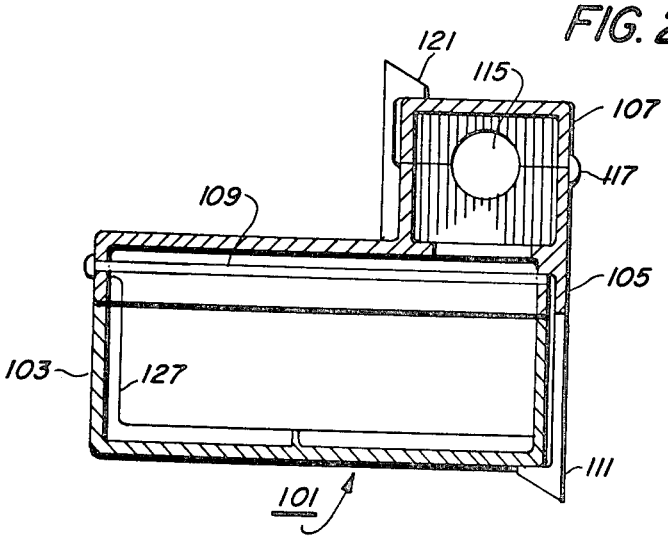

FIGS. 2A and 2B of the present invention show the side views of the connector box 101, with FIG. 2A depicting the box in its open position and FIG. 2B showing the box in its closed position, the configuration seen in FIGS. 1A and 1B. FIGS. 1A and 1B would be viewed from the right of the drawings in FIGS. 2A and 2B.

The connector box in FIGS. 2A and 2B is shown hinged at points 117 and 125. If the box 101 is made of one piece of plastic, then hinges 117 and 125 would be of the material as the body of the box and be a continuous piece of polypropylene, or other, plastic. The box could, however, be made in separate sections with externally mounted hinges. In fact, flat pieces of resilient polypropylene could be glued or riveted on to provide resilient hinges within the principles of the present invention.

As can be seen in FIG. 2A, the cover 105 pivots about point 125. When the cover 105 is to be closed over bottom portion 103, slanted leading edge 129 of extension 111 strikes point 133 of the wall of bottom section 103. A constant, and light, pressure on the cover causes the extension to deform outward slightly due to the angle of face 129. After complete deformation, the box now closes and surface 131 of projection 111 snaps back into undeformed position at point 141 in its travel thus closing and locking the cover 105 and bottom section of the box. A similar description for projection 113, in FIG. 1A, may be made, but is not seen in FIGS. 2A and 2B. FIG. 2B shows the box in a completely closed position.

The top section of the box 107 opens and closes in a similar manner. The top 107 pivots about hinge or plastic (see above) provision 117. Slanted face 135 of arm 121 causes arm 121 to deflect outwardly due to contact at point 139, thus deforming arm 121 until the top is closed when surface 137 reaches the end of its travel, undeforms and locks the top piece 107 to the cover 105. Hole 115 is seen to receive the coaxial cable (see FIG. 1B).

FIG. 2B, as set forth above, shows the connector box 101 in its fully closed position. Item 127, shown in this figure only, is a series of strengthening ribs within the box. Item 109 is the printed circuit board shown and described in conjunction with FIG. 1B.

Figure 3A:
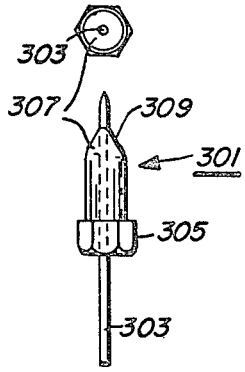
FIG. 3A shows a top and front view of the needle probe of the present invention; with FIG. 3B showing the needle probe in place in the mounting block as coupled to the metal band and coaxial cable.
Figure 3B:
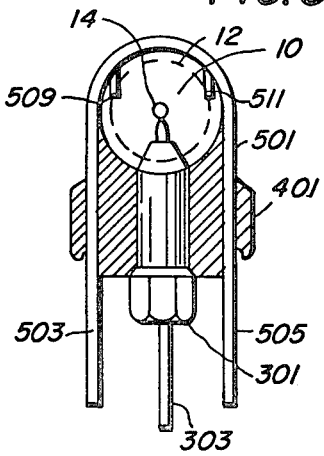

Referring now to FIGS. 3A and 3B, it is seen how the probe 301, the mounting block 401 and the metal band are configured. The area 305 is in the shape of a bolt, having six or so sides to receive a wrench for loosening and tightening. The tubular section 307 of the probe may be provided with screw threads to assist in mounting the probe in the transmission cable 10. The lower end of center conductor 303 in FIG. 3A could be flat or pointed depending on the method of mounting electrical connections to the lead. The upper end of center conductor 303 in FIG. 35 is pointed, to help in penetrating the outer layers of the cable 10 to reach center conductor 14, and also to maintain a clear, sharp contact once the apparatus herein is installed. The insulating section 305, 307 of the probe could be made of delrin or Teflon; while the center conductor 303 could be made of beryllium copper.

FIG. 3B shows the entire ensemble of metal band 501, mounting block 401, and probe 301 together with a cross sectional view of a coaxial cable 10. Probe 301 is seen mounted in mounting block 401 with the sharp end of the center conductor 303 making contact with the center conductor 14 of cable 10. Prongs 509, 511 are seen in cross section to be piercing the outer covering of the cable and making physical and electrical contact with the outer braided conductor of said cable.

Figure 4A:
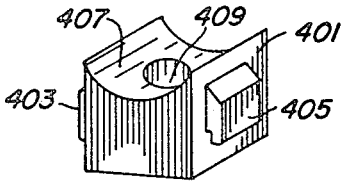
FIGS. 4A and 4B are isometric and front section views of the mounting block of the present invention.
Figure 4B:
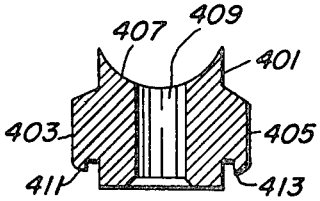

FIGS. 4A and 4B depict the insulating mounting block 401 which holds the probe 301 in place. The mounting block 401 could comprise delrin or Teflon. FIG. 4B is a cross sectional view of block 401. Also seen are the two arms 403, 405 which extend through the holes 513 and 515, respectively, of metal band 501. Formed in each arm 403, 405 are undercut lips 411, 413 to provide a locking feature to ensure that the block does not slip out of metal band 501. FIG. 3B shows the mounting block situated in the metal band 501 with the undercut lips 411, 413 preventing the mounting block from falling out of the metal band 501.

The upper surface 407 of the block 401 is formed in a radius of curvature to match that of the selected coaxial cable transmission line. Hole 409 is placed in the block to mount the probe with screw threads cut therein as desired for the probe 301. The probe 301 would be screwed into the mounting block with the point of conductor 303 piercing, in order, the outer layer, braided conductor, inner insulating layer, to contact the center conductor of the cable. The tapered leading edge 309 of the insulating tubular member part of probe 301 is utilized for spreading the braided leads of the outer conductor of the coaxial cable. This prevents the outer braided conductor 12 of the cable 10 from accidently contacting the center conductor 303 of the probe and causing a short circuit.

Figure 5:
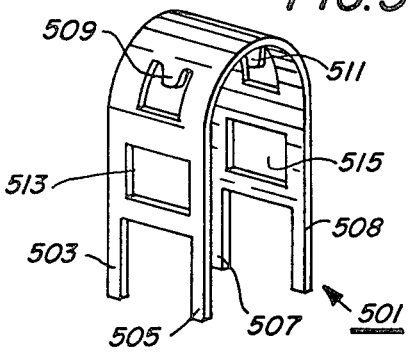
FIG. 5 is an isometric view of the metal band of the present invention.

FIG. 5 shows the metal clip 501 used in accordance with the principles of the present invention. The band 501 can be punched, for example, from a flat piece of metal and bent and formed as indicated. Holes 513 and 515 are provided to receive the arms 403, 405 of block 401. Prongs 509, 511 are bent inwardly so as to pierce the outer layer and contact the outer braided conductor of the cable when the clip is mounted to the cable. Legs of extensions 503, 505, 507, 508, are provided to allow connection to the printed circuit board 109, as seen in FIG. 1B. The clip may be made of spring steel or similar material.

While the invention has been described with reference to specific embodiments, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. Coaxial cable connection apparatus wherein the improvement is characterized by:

a metal band member (501) in a substantially U-shaped configuration, the radius of curvature of said band member being substantially equal to the radius of curvature of a coaxial cable (10) to which said apparatus is to be connected without cutting the cable, said band member having (a) at least two inwardly pointed prongs (509, 511) along the curved portion thereof to pierce the cable and contact an outer braided conductor (12) of the cable (10), (b) a rectangular hole (513, 515) in each straight portion of said member, and (c) at least two legs (503, 505, 507, 508) extending outwardly from and pointing in the same direction as each straight portion of said member, an insulating mounting block (401), said mounting block being substantially rectangular with two arms (403, 405) extending out from opposite sides of said block (401), said arms being undercut to allow a locking arrangement when said mounting block is mounted in said band member (501) with said armss (403, 405) protruding through said holes (513, 515) of said band member (501), the top surface of said mounting block (401) being curved to also be substantially equal to the radius of curvature of said cable, such that when said band member is put around said coaxial cable and said mounting block is mounted to the band member and against said cable, the band member and mounting block completely surround the coaxial cable in a fixed, locked configuration, an electrical probe (301) for installation in a hole (409) in said mounting block (401), said probe (301) having a center conducting metal electrode, one end of which is pointed, a cylindrical, tubular shaped insulator (307) surrounding the center electrode (303), said insulator being tapered at the end of the insulator adjacent the pointed end of said center electrode, said hole (409) and insulator (307) having matching screw threads for installation of said probe into the cable via the mounting block (401), such that as said probe (301) is screwed into the mounting block (401) the pointed end of the center electrode (303) pierces an outer cover, the braided outer conductor, and an inner insulating portion, respectively, of the cable to a position where the pointed end of said conductor comes into touching and electrical contact with a center conductor of said cable, the other end of said center electrode (303) and the extensions (503, 505, 507, 508) of said band member (501) providing the signal paths to and from said coaxial cable, and a connector box (101) in which is mounted said electrical probe (301), said mounting block (401) and said band member (501), said box (101) being in three sections, a bottom section (103), a cover or middle section (105), and a top section (107), said top section being hingedly mounted to said middle section and adapted to receive the cable such that when said top section is closed to the middle section, the entire box (101) is securely fixed to said cable, and wherein said cover section is hingedly mounted to said bottom section, said bottom section containing connection apparatus for connecting said cable electrically to a using device, such that when said middle section is closed to the bottom section, the cover is securely closed over said connection apparatus.

2. The coaxial cable connection apparatus as set forth in claim 1, wherein the center sectin (105) of said connector box (101) has a pair of upwardly extending locking projection (121, 123) and a pair of downwardly extending locking projections (111, 113), said projections each having inwardly extending feet, said feet having a slanted leading edge, such that as said top section (107) and said bottom section (103) are closed toward said middle section (105), the slanted feet of said projections contact the leading edges of said top and bottom sections and deform slightly outwardly to allow the top and bottom sections to close completely, when the feet will extend back to their original positions to thereby prevent the top and bottom sections from opening.

* * * * *

UNITED STATES PATENT AND TRADEMARK OFFICE

CERTIFICATE OF CORRECTION

PATENT NO. 4,266,842

DATED May 12, 1981

INVENTOR(S) : Robert F. Dillon, Jr., et al

It is certified that error appears in the above-identified patent and that said Letters Patent are hereby corrected as shown below:

Cover page, change the Assignee from "Zerox Corporation" to --Xerox Corporation--.

Claim 1, line 23 (Col. 5, line 39), delete "armss" and insert --arms--.

Claim 2, line 2, (Col. 6, line 37), delete "sectin", and insert --section--.

Claim 2, line 4, (Col. 6 line 39), delete "projection", and insert --projections--.

Signed and Sealed this

*Eleventh* Day of *August 1981*

[SEAL]

*Attest:*

GERALD J. MOSSINGHOFF

*Attesting Officer*

*Commissioner of Patents and Trademarks*